US006476365B1

(12) United States Patent
Rios

(10) Patent No.: US 6,476,365 B1
(45) Date of Patent: Nov. 5, 2002

(54) TOILET PAPER DISPENSER

(76) Inventor: Refugio G. Rios, 3587 Castro Valley Blvd., Castro Valley, CA (US) 94546

( * ) Notice: Subject to any disclaimer, the term of this patent is extended or adjusted under 35 U.S.C. 154(b) by 0 days.

(21) Appl. No.: 09/876,963

(22) Filed: Jun. 8, 2001

(51) Int. Cl.[7] ..... H05B 3/06
(52) U.S. Cl. ..... 219/521; 242/596.6
(58) Field of Search ..... 219/521, 386; 221/45, 150 A, 96; 242/564.1, 598.6; 118/264, 405; 206/233; 222/180; 225/48

(56) References Cited

U.S. PATENT DOCUMENTS

| | | | | | |
|---|---|---|---|---|---|
| D166,782 | S | | 5/1952 | Weskrna | |
| 3,947,134 | A | | 3/1976 | Ogawa | |
| 4,655,377 | A | * | 4/1987 | Orangeo et al. | 225/48 |
| 4,721,264 | A | | 1/1988 | Muscarello | |
| 4,857,708 | A | | 8/1989 | Demars | |
| 4,964,543 | A | * | 10/1990 | Scheiber | 222/180 |
| 5,210,396 | A | | 5/1993 | Sanders | |
| 5,277,332 | A | * | 1/1994 | Rogers | 221/96 |
| 5,311,986 | A | * | 5/1994 | Putz | 206/233 |
| 5,697,577 | A | | 12/1997 | Ogden | |
| 5,951,762 | A | * | 9/1999 | Shangold et al. | 118/405 |
| 6,059,882 | A | * | 5/2000 | Steinhardt et al. | 118/264 |
| 6,179,162 | B1 | * | 1/2001 | Motsenbocker | 221/150 A |
| 6,213,424 | B1 | * | 4/2001 | Helfer-Grand | 242/564.1 |
| 6,237,805 | B1 | * | 5/2001 | Katsanevas | 221/45 |
| 6,392,200 | B1 | * | 5/2002 | Nakamura et al. | 219/386 |

FOREIGN PATENT DOCUMENTS

| | | | | |
|---|---|---|---|---|
| JP | 2002037356 | * | 2/2002 | B65D/83/08 |
| KR | 2001108591 A | * | 12/2001 | A47K/10/32 |

* cited by examiner

*Primary Examiner*—Teresa Walberg
*Assistant Examiner*—Leonid Fastovsky

(57) ABSTRACT

A toilet paper dispenser for providing heated toilet paper having lotion thereon. The toilet paper dispenser includes a roll of toilet paper partially saturated with a lotion. A housing has a top portion, and a bottom portion. Each of the top and bottom portions has a first side wall, a second side wall, a front edge and a back edge. The back edges are pivotally coupled together. A pair of supports support the housing on the vertical wall. Each of the supports is attached to one of the side walls of the bottom portion and each of the supports is attached to the vertical wall. A spindle is removably extended into each of the side walls of the bottom portion. The spindle extends through the roll of toilet paper. A heating element is positioned in the housing and attached to the bottom portion of the housing.

6 Claims, 4 Drawing Sheets

TOILET PAPER DISPENSER

BACKGROUND OF THE INVENTION

1. Field of the Invention

The present invention relates to toilet paper dispensers and more particularly pertains to a new toilet paper dispenser for providing heated toilet paper having lotion thereon.

2. Description of the Prior Art

The use of toilet paper dispensers is known in the prior art. More specifically, toilet paper dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,697,577; U.S. Pat. No. 3,947,134; U.S. Pat. No. 5,210,396; U.S. Pat. No. 4,857,708; U.S. Pat. No. 4,721,264; and U.S. Des. Pat. No. 166,782.

While these devices fulfill their respective, particular objectives and requirements, the aforementioned patents do not disclose a new toilet paper dispenser. The inventive device includes a roll of toilet paper partially saturated with a lotion. The lotion has an anti-bacterial agent therein. The toilet paper has sufficient strength to be selectively unrolled. A housing has a top portion, and a bottom portion. Each of the top and bottom portions has a first side wall, a second side wall, a front edge and a back edge. The back edges are pivotally coupled together. A pair of supports support the housing on the vertical wall. Each of the supports is attached to one of the side walls of the bottom portion and each of the supports is attached to the vertical wall. A spindle is removably extended into each of the side walls of the bottom portion. The spindle extends through the roll of toilet paper. A heating element is positioned in the housing and attached to the bottom portion of the housing.

In these respects, the toilet paper dispenser according to the present invention substantially departs from the conventional concepts and designs of the prior art, and in so doing provides an apparatus primarily developed for the purpose of providing heated toilet paper having lotion thereon.

SUMMARY OF THE INVENTION

In view of the foregoing disadvantages inherent in the known types of toilet paper dispensers now present in the prior art, the present invention provides a new toilet paper dispenser construction wherein the same can be utilized for providing heated toilet paper having lotion thereon.

The general purpose of the present invention, which will be described subsequently in greater detail, is to provide a new toilet paper dispenser apparatus and method which has many of the advantages of the toilet paper dispensers mentioned heretofore and many novel features that result in a new toilet paper dispenser which is not anticipated, rendered obvious, suggested, or even implied by any of the prior art toilet paper dispensers, either alone or in any combination thereof.

To attain this, the present invention generally comprises a roll of toilet paper partially saturated with a lotion. The lotion has an anti-bacterial agent therein. The toilet paper has sufficient strength to be selectively unrolled. A housing has a top portion, and a bottom portion. Each of the top and bottom portions has a first side wall, a second side wall, a front edge and a back edge. The back edges are pivotally coupled together. A pair of supports support the housing on the vertical wall. Each of the supports is attached to one of the side walls of the bottom portion and each of the supports is attached to the vertical wall. A spindle is removably extended into each of the side walls of the bottom portion. The spindle extends through the roll of toilet paper. A heating element is positioned in the housing and attached to the bottom portion of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet paper dispenser apparatus and method which has many of the advantages of the toilet paper dispensers mentioned heretofore and many novel features that result in a new toilet paper dispenser which is not anticipated, rendered obvious, suggested, or even implied by any of the prior art toilet paper dispensers, either alone or in any combination thereof.

It is another object of the present invention to provide a new toilet paper dispenser which may be easily and efficiently manufactured and marketed.

It is a further object of the present invention to provide a new toilet paper dispenser which is of a durable and reliable construction.

An even further object of the present invention is to provide a new toilet paper dispenser which is susceptible of a low cost of manufacture with regard to both materials and labor, and which accordingly is then susceptible of low prices of sale to the consuming public, thereby making such toilet paper dispenser economically available to the buying public.

Still yet another object of the present invention is to provide a new toilet paper dispenser which provides in the apparatuses and methods of the prior art some of the advantages thereof, while simultaneously overcoming some of the disadvantages normally associated therewith.

Still another object of the present invention is to provide a new toilet paper dispenser for providing heated toilet paper having lotion thereon.

Yet another object of the present invention is to provide a new toilet paper dispenser which includes a roll of toilet paper partially saturated with a lotion. The lotion has an anti-bacterial agent therein. The toilet paper has sufficient strength to be selectively unrolled. A housing has a top portion, and a bottom portion. Each of the top and bottom portions has a first side wall, a second side wall, a front edge and a back edge. The back edges are pivotally coupled together. A pair of supports support the housing on the vertical wall. Each of the supports is attached to one of the side walls of the bottom portion and each of the supports is attached to the vertical wall. A spindle is removably extended into each of the side walls of the bottom portion. The spindle extends through the roll of toilet paper. A heating element is positioned in the housing and attached to the bottom portion of the housing.

Still yet another object of the present invention is to provide a new toilet paper dispenser that has a heating element therein for heating toilet paper disposed within the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
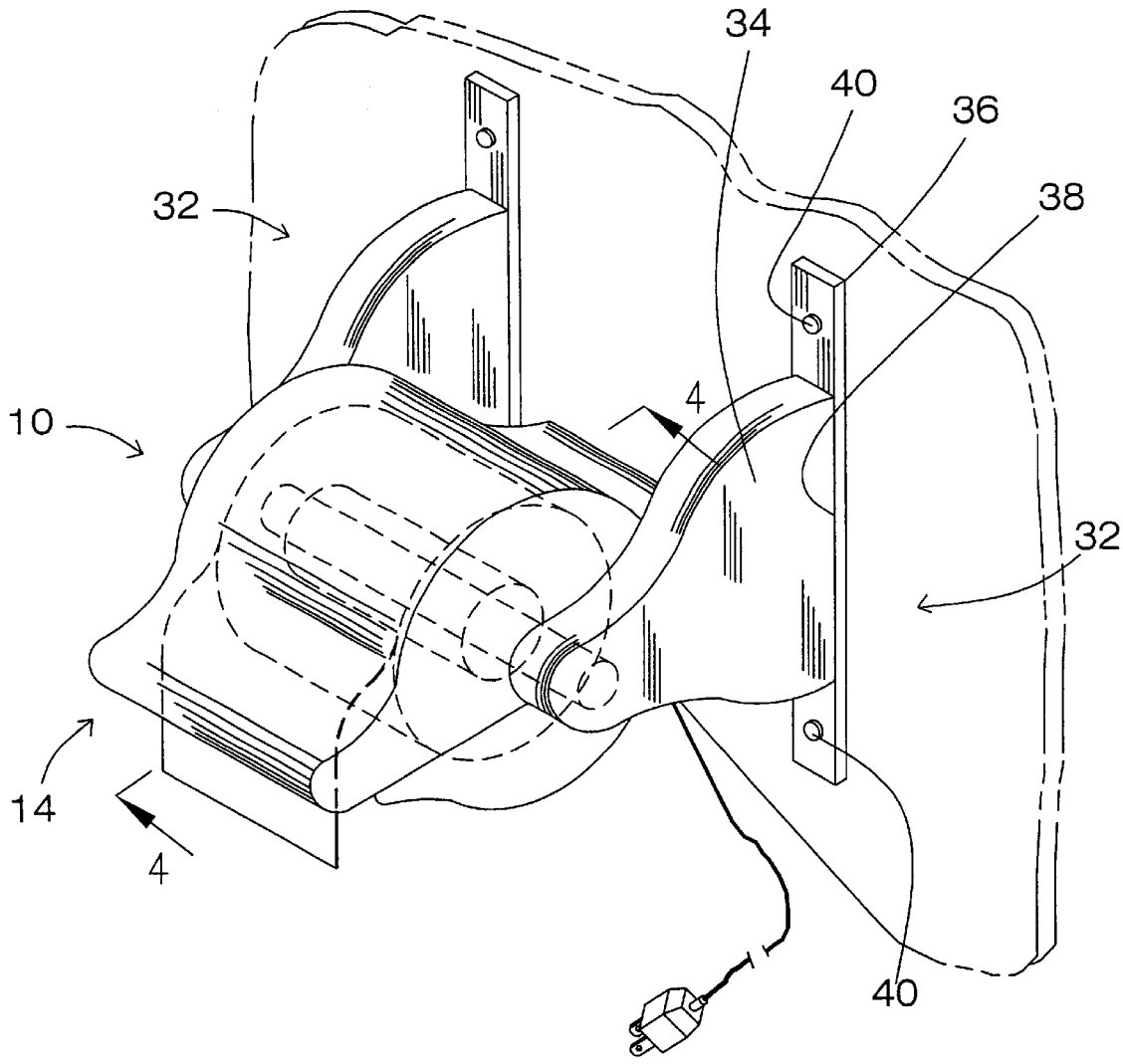
FIG. 1 is a schematic perspective view of a new toilet paper dispenser according to the present invention.
Figure 2:
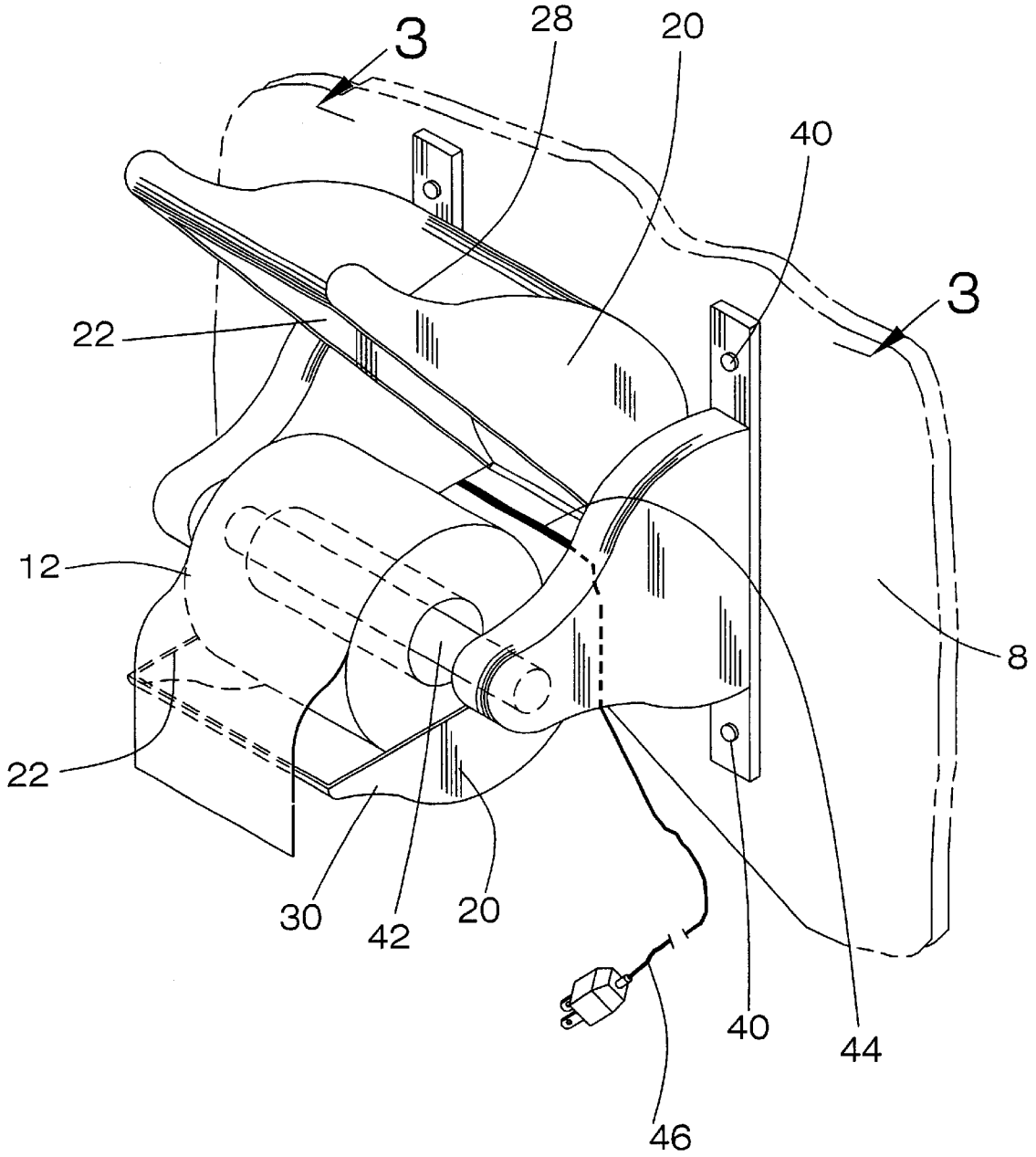
FIG. 2 is a schematic perspective view of the present invention.
Figure 3:
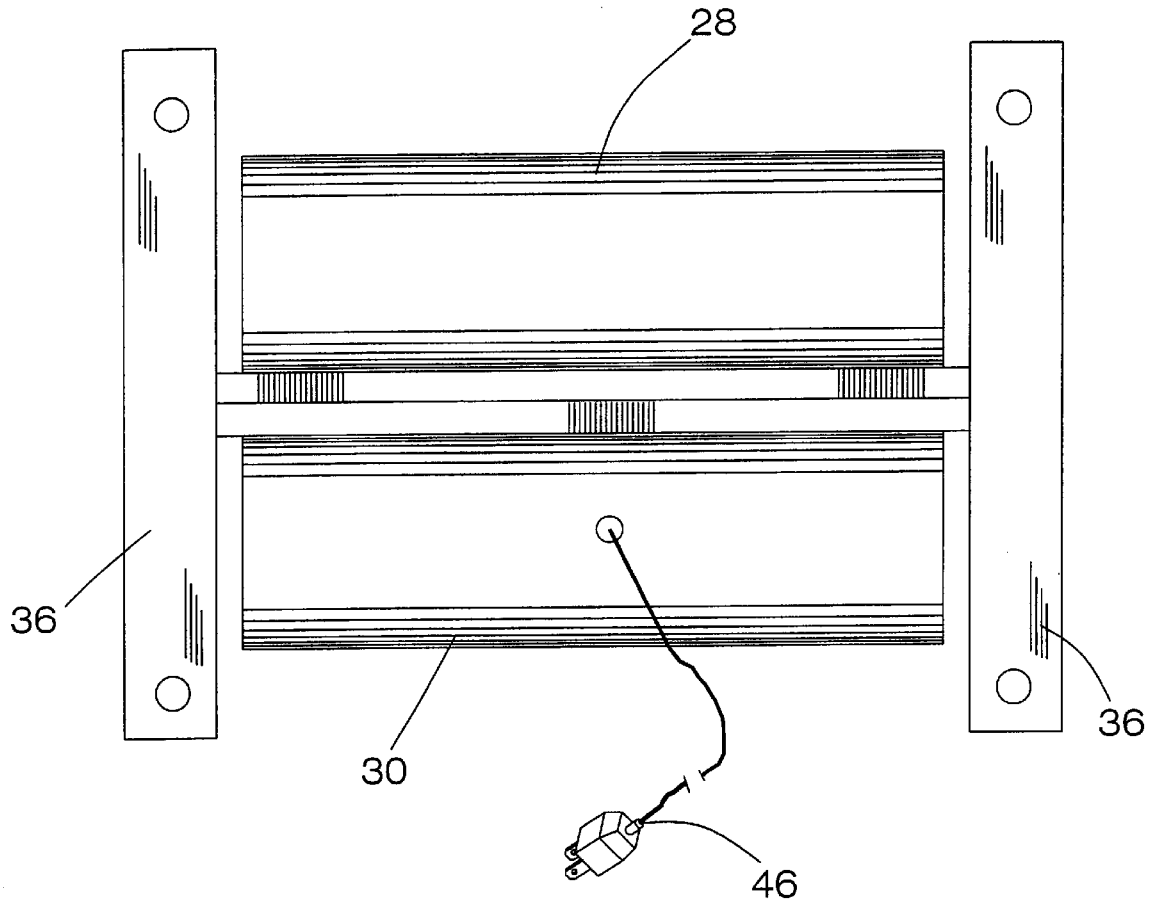
FIG. 3 is a schematic back view of the present invention.
Figure 4:
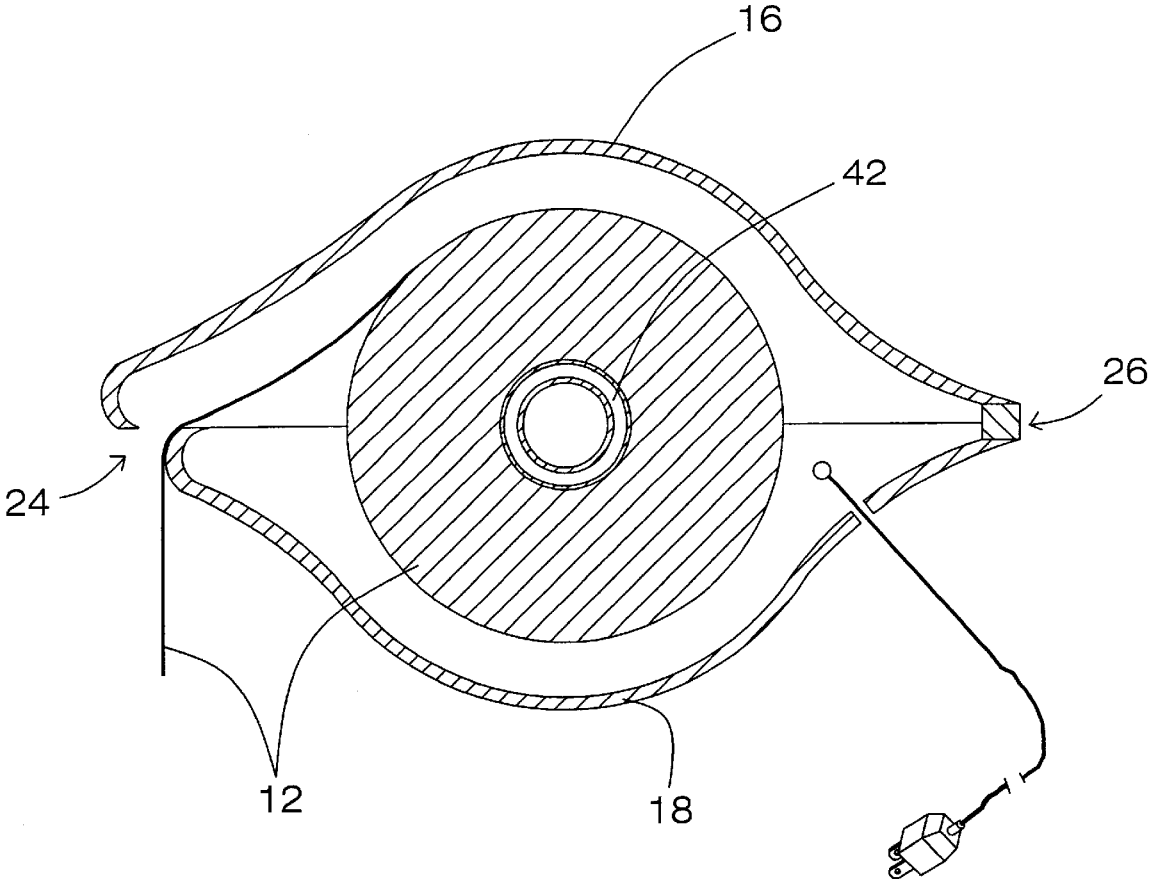
FIG. 4 is a schematic cross-sectional view taken along line 3—3 of the present invention.

With reference now to the drawings, and in particular to FIGS. 1 through 4 thereof, a new toilet paper dispenser embodying the principles and concepts of the present invention and generally designated by the reference numeral 10 will be described.

As best illustrated in FIGS. 1 through 4, the toilet paper dispenser 10 includes a roll of toilet paper 12 partially saturated with a lotion. The lotion has a conventional anti-bacterial agent therein. The toilet paper 12 has sufficient strength to be selectively unrolled. Ideally, the toilet paper 12 is composed of a plurality of layers, greater than 2, for holding an amount of lotion greater than conventional 2-ply toilet paper.

A housing 14 has a top wall 16, a bottom wall 18, a first side wall 20 and a second side wall 22. Each of the top 16 and bottom 18 walls tapers toward a front edge 24 and a back edge 26. The housing 14 is divided into a top portion 28 and a bottom portion 30 along a plane extending through the front 24 and back 26 edges. The back edge 26 of the top portion 28 is pivotally coupled to the back edge 26 of the bottom portion 30. The front edge 24 of the top portion 28 extends farther away from the back edge 26 than the front edge 24 of the bottom portion 30.

A pair of supports 32 support the housing on a vertical wall. Each of the supports 32 includes an arm portion 34 and a plate 36. Each of the arms 34 is attached to one of the side walls 20, 22 of the bottom portion 30. Each of the arm portions 34 has a free end 38 extending past the back edge 26 of the housing 14. Each of the plates 36 is attached to one of free ends. Each of the plates 36 generally lies a plane orientated generally perpendicular to the plane extending through the front 24 and back 26 edges. Each of a plurality of fasteners 40 extends through one of the plates 36 and into a vertical wall 8.

A spindle 42 is removably extended into each of the side walls 20, 22 of the bottom portion 30. The spindle 42 extends through the roll of toilet paper 12 such that the toilet paper is rotatably positioned on the spindle 42. The spindle 42 is a conventional type used for dispensing toilet paper.

A heating element 44 is positioned in the housing and attached to the bottom portion 30 of the housing 14. The heating element 44 is positioned generally adjacent to the back edge 26 and is operationally coupled to a power supply. The power supply is ideally a male cord 46 for plugging into a conventional outlet, however batteries are also envisioned.

In use, the toilet paper 12 is used as conventional toilet paper, however the lotion and warmth of the toilet paper is more comfortable to use for those suffering from hemorrhoids or other sores. The anti-bacterial component helps to prevent infections.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet paper heating and dispensing system for attaching to a vertical wall, said system comprising:

a roll of toilet paper being partially saturated with a lotion, said lotion having an anti-bacterial agent therein, said toilet paper having sufficient strength to be selectively unrolled;

a housing having a top portion, and a bottom portion, each of said top and bottom portions having a first side wall, a second side wall, a front edge and a back edge, said back edges being pivotally coupled together;

a pair of supports for supporting said housing on said vertical wall, each of said supports being attached to one of said side walls of said bottom portion, each of said supports being attached to said vertical wall;

a spindle being removably extended into each of said side walls of said bottom portion, said spindle extending through said roll of toilet paper; and a heating element being positioned in said housing and attached to said bottom portion of said housing.

2. The toilet paper heating and dispensing system as in claim 1, wherein said housing has a top wall and a bottom wall, each of said top and bottom walls tapering toward said front edge and said back edge.

3. The toilet paper heating and dispensing system as in claim 1, wherein said front edge of said top portion extends outwardly from said back edge farther than said front edge of said bottom portion.

4. The toilet paper heating and dispensing system as in claim 1, wherein each of said supports includes an arm portion and a plate, each of said arms being attached to one of said side walls of said bottom portion, each of said arm portions having a free end extending past said back edge of said housing, each of said plates being attached to one of free ends, each of said plates generally lying a plane orientated generally perpendicular to a plane extending through said front and back edges, each of a plurality of fasteners extending through one of said plates and into said vertical wall.

5. The toilet paper heating and dispensing system as in claim 1, wherein said heating element is operationally coupled to a power supply, said power supply comprising a male plug.

6. A toilet paper heating and dispensing system for attaching to a vertical wall, said system comprising:

a roll of toilet paper being partially saturated with a lotion, said lotion having an anti-bacterial agent therein, said toilet paper having sufficient strength to be selectively unrolled;

a housing having a top wall, a bottom wall, a first side wall and a second side wall, each of said top and bottom walls tapering toward a front edge and a back edge, said housing being divided into a top portion and a bottom portion along a plane extending through said front and back edges, said back edge of said top portion being pivotally coupled to said back edge of said bottom portion, said front edge of said top portion extending outwardly farther from said back edge than said front edge of said bottom portion;

a pair of supports for supporting said housing on said vertical wall, each of said supports including an arm portion and a plate, each of said arms being attached to one of said side walls of said bottom portion, each of said arm portions having a free end extending past said back edge of said housing, each of said plates being attached to one of free ends, each of said plates generally lying a plane orientated generally perpendicular to said plane extending through said front and back edges, each of a plurality of fasteners extending through one of said plates and into said vertical wall;

a spindle being removably extended into each of said side walls of said bottom portion, said spindle extending through said roll of toilet paper such that said toilet paper is rotatably positioned on said spindle; and a heating element being positioned in said housing and attached to said bottom portion of said housing, said heating element being positioned generally adjacent to said back edge, said heating element being operationally coupled to a power supply.

* * * * *